US006618862B1

(12) United States Patent
Bunjes

(10) Patent No.: US 6,618,862 B1
(45) Date of Patent: Sep. 16, 2003

(54) PANTS HEM GUARD

(76) Inventor: Douglas Bunjes, P.O. Box 728, San Marcos, CA (US) 92079

( * ) Notice: Subject to any disclaimer, the term of this patent is extended or adjusted under 35 U.S.C. 154(b) by 0 days.

(21) Appl. No.: 10/056,514

(22) Filed: Jan. 25, 2002

(51) Int. Cl.[7] ..... A41D 1/06
(52) U.S. Cl. ..... 2/232; 24/335; 36/70 R
(58) Field of Search ..... 2/232, 455, 22, 2/79, 227, 69, 243.1, 911; 24/335, 336; 36/70 R, 70 A

(56) References Cited

U.S. PATENT DOCUMENTS 229,031 A * 6/1880 Campbell ..... 2/232
668,051 A * 2/1901 Puffer ..... 36/70 R
771,021 A * 9/1904 Lux ..... 2/232
898,503 A * 9/1908 Plummer ..... 24/299
927,017 A * 7/1909 Young ..... 36/70 R

* cited by examiner

*Primary Examiner*—Tejash Patel
(74) *Attorney, Agent, or Firm*—Goldstein & Lavas, P.C.

(57) ABSTRACT

A pants hem guard, for attachment to a shoe, having a frame with a U-shaped inner portion and a U-shaped outer portion, and a clip insert attached to the outer portion of the frame. The outer portion has two ends attached to a rear surface of the clip insert. A pair of horizontal members connect the inner and outer portions so that the frame is one continuous piece. The guard is attached to the back portion of a shoe, with the clip insert remaining on the outside of the shoe just above the shoe heel. A pants hem is tucked behind the clip insert and keeps the hem above the shoe heel.

4 Claims, 2 Drawing Sheets

Fig. 1
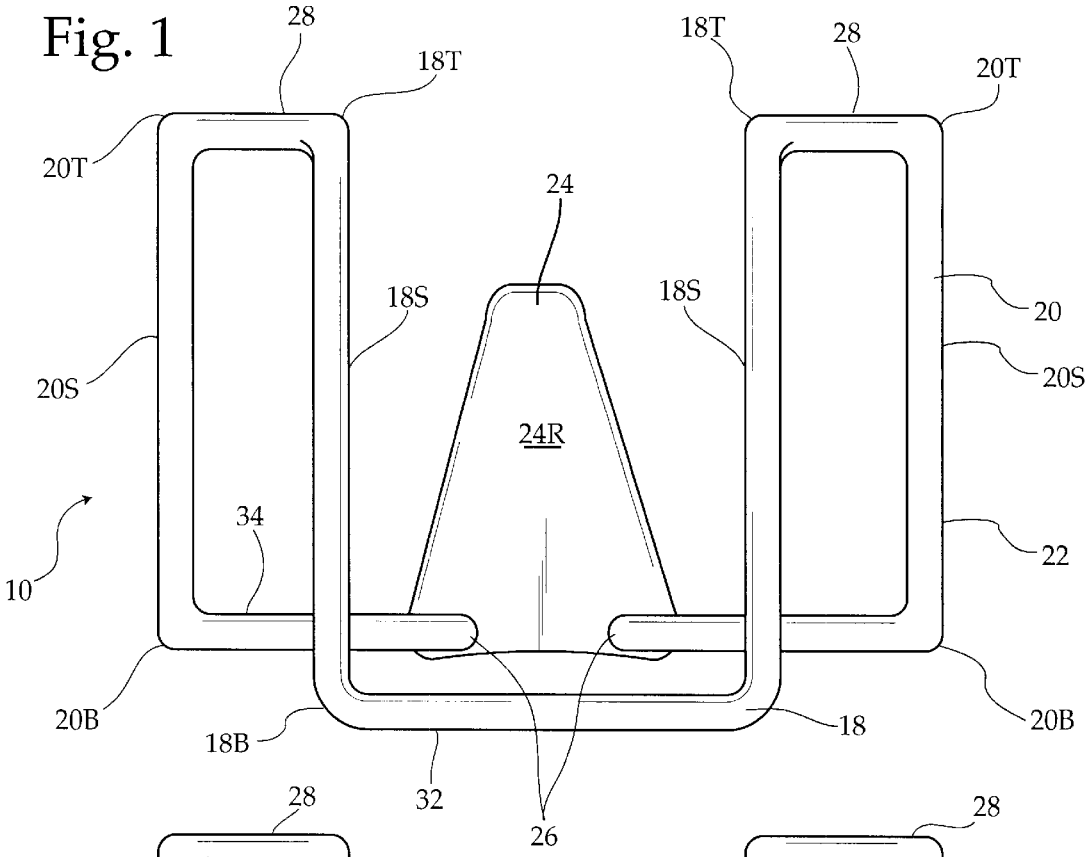
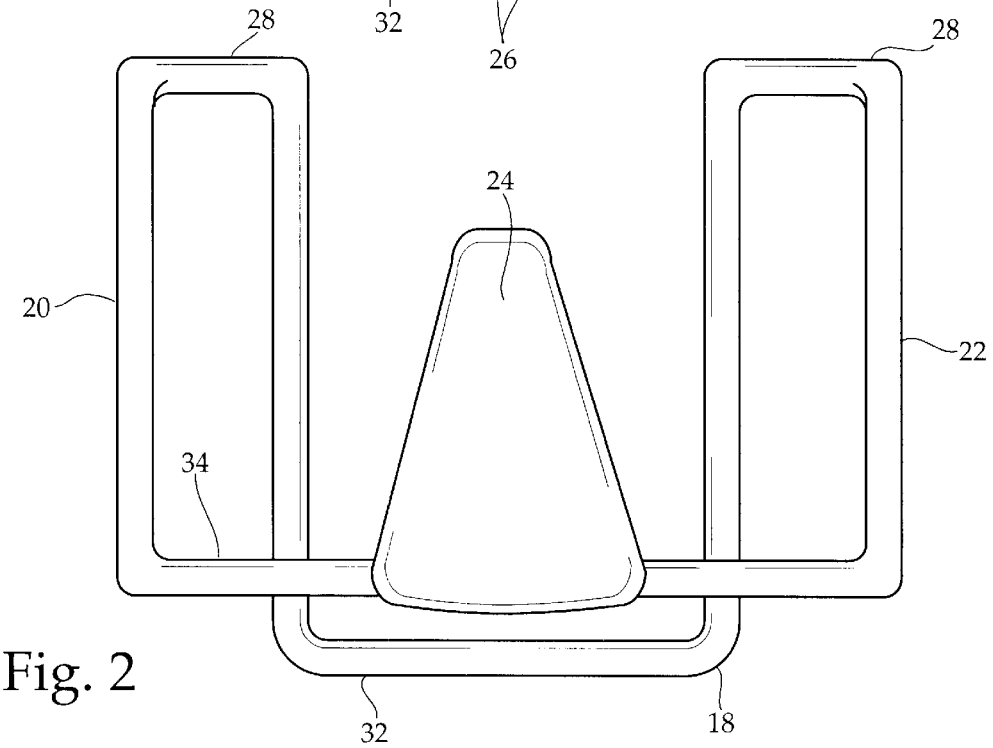
Fig. 2

PANTS HEM GUARD

BACKGROUND OF THE INVENTION

The invention relates to a pants hem guard. In particular, the invention is a guard that is attached to the back of a shoe and holds a pants hem in place, above the heel of the shoe.

The present fashion styles include pants that have a longer length. In particular, extra baggy, long pants have become stylish. When walking while wearing this type of pants, it is common for the hem or cuff of the pants to get caught under the heel of a person's shoe. Besides causing the pants to get dirty from dragging on the ground, it is also possible for the hem of the pants to be ripped. Once ripped, it is often necessary to discard the garment.

Thus, there exists a need for a guard that serves to protect the hems of a pair of pants having a longer length than the average pants. Such a guard may be attached to the back of a pair of shoes and then used to hold the hem in place. While this type of device may prevent the hem from falling under a wearer's shoe, it is important that the front of the pants are allowed to drape in a natural fashion.

While these units may be suitable for the particular purpose employed, or for general use, they would not be as suitable for the purposes of the present invention as disclosed hereafter.

SUMMARY OF THE INVENTION

In view of the foregoing disadvantages inherent in the prior art, the present invention provides an improved pants hem guard for attachment to a shoe. As such, the general purpose of the present invention, which will be described subsequently in greater detail, is to provide a new and improved pants hem guard which has all the advantages of the prior art and none of the disadvantages.

To attain this, the present invention essentially comprises a pants hem guard, for attachment to a shoe, having a frame with a U-shaped inner portion and a U-shaped outer portion, and a clip insert attached to the outer portion of the frame. The outer portion has two ends attached to a rear surface of the clip insert. A pair of horizontal members connect the inner and outer portions so that the frame is one continuous piece. The guard is attached to the back portion of a shoe, with the clip insert remaining on the outside of the shoe just above the shoe heel. A pants hem is tucked behind the clip insert and keeps the hem above the shoe heel.

It is an object of the invention to produce a pants hem guard that protects the bottom of a pair of pants from damage. Accordingly, the guard is designed to fit within any pair of shoes having a back portion and serves to hold the hem of the pants in place above the shoe heel.

It is a further object of the invention to produce a pants hem guard that is inconspicuous and does not interrupt with the natural drape of the pants. Accordingly, the guard is barely visible when in place, with only the clip insert extending over the pants hem. Further, since the clip insert only holds the back portion of the pants hem, the remainder of the hem is interrupted.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

FIG. 1 is a rear elevational view of the pants hem guard.

FIG. 2 is a front elevational view of the pants hem guard.

REFERENCE NUMERALS

Figure 3:
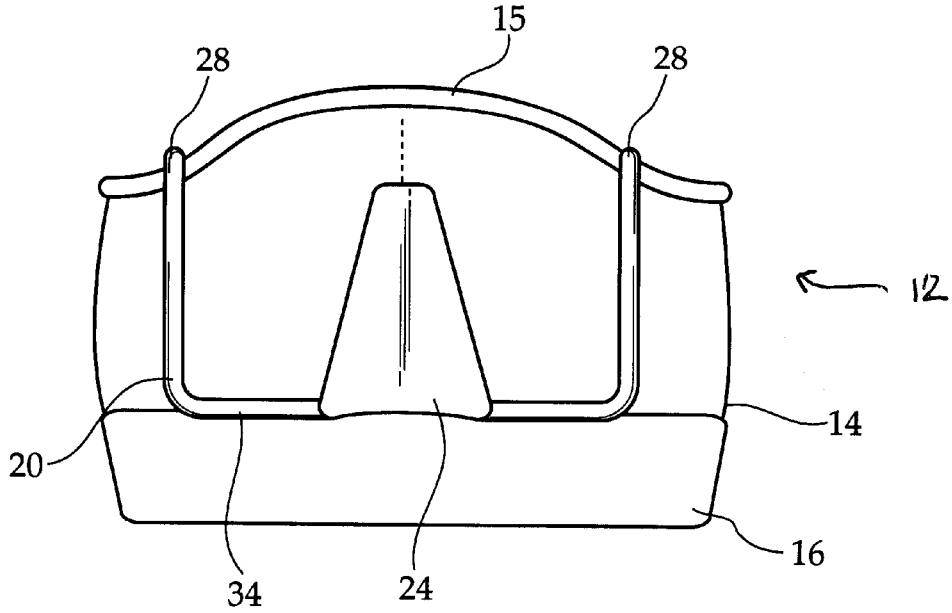
FIG. 3 is a front elevational view of the pants hem guard attached to the back portion of a shoe.
Figure 4:
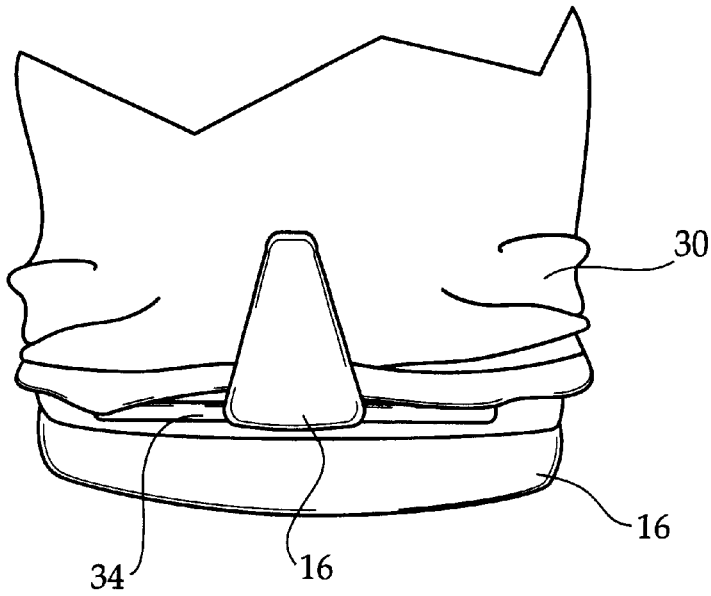
FIG. 4 is a front elevational view of the pants hem guard attached to the back portion of a shoe, with a pants hem tucked behind the clip insert of the guard.

10 pants hem guard
12 shoe
14 back portion of shoe
15 top rim of shoe
16 shoe heel
18 inner portion of frame
18S sides of inner portion of frame
18T top end of sides of inner portion of frame
18B bottom end of sides of inner portion of frame
20 outer portion of frame
20S sides of outer portion of frame
20T top end of sides of outer portion of frame
20B bottom end of sides of outer portion of frame
22 frame of guard
24 clip insert
24R rear surface of clip insert
26 ends of outer portion of frame
28 horizontal members of frame
30 pants hem
32 bottom member of inner portion of frame
34 bottom member of outer portion of frame

DETAILED DESCRIPTION OF THE PREFERRED EMBODIMENTS

FIGS. 1 and 2 illustrate a pants hem guard 10 for attachment to a shoe 12. The shoe 12 comprises a back portion 14 that covers a wearer's heel, a top rim 15, and a shoe heel 16 that comes into direct contact with the ground surface.

The guard 10 comprises a frame 22, having a U-shaped inner portion 18 and a U-shaped outer portion 20, and a clip insert 24 attached to the outer portion 20 of said frame 22. The U-shaped portions 18, 20 each have a pair of sides 18S, 20S, the sides 18S, 20S each having a bottom end 18B, 20B and a top end 18T, 20T. The inner and outer portions 18, 20 further comprise a bottom member 32, 34 respectively, extending between the respective bottom ends 18B, 20B of said sides 18S, 20S. The bottom member 34 of the outer portion 20 has two ends 26 towards the center of the member 34, said ends 26 attached to a rear surface 24R of the clip insert 24. A horizontal member 28 extends between the corresponding top ends 18T, 20T of the inner and outer portions 18, 20, thereby connecting the portions 18, 20 so that the frame 22 is one continuous piece, commencing and ending at the ends 26 of the outer portion 20, along the rear surface 24R the clip insert 24. The continuity of the frame 22 adds strength to the guard 10 when attached to a shoe 12. The outer portion 20 extends wider than the inner portion 18, while the inner portion 18 is longer than said outer portion 20. It is preferable that the guard 10 be constructed from a lightweight, flexible material in order to allow said guard 10 to be properly bent over the top rim 15 of the shoe 12.

In use, the guard 10 is attached to the back portion 14 of a shoe 12, as illustrated in FIG. 3. The inner portion 18 of the frame 22 is inserted inside the shoe 12, at the back portion 14 of said shoe 12, and pushed downward into the shoe 12 until the bottom member 32 of the inner portion 18 touches the inside bottom surface of the shoe 12 and the horizontal members 28 of the frame 22 rest upon the top rim 15 of the back portion 14 of the shoe 12. Once properly inserted inside the shoe 12, the outer portion 20 of the frame 22 is positioned on the outside of the shoe 12 in such a manner that the bottom member 34 of the outer portion 20 lies just above the shoe heel 16. The clip insert 24 extends upward towards the top rim 15 of the shoe 12, with the rear surface 24R of said insert 24 extending parallel to the shoe 12, and leaving a slight space between the back portion 14 of the shoe 12 and the clip insert 24. A pants hem 30 is tucked behind the clip insert 24, between the clip insert 24 and the shoe 12, thereby keeping the hem 30 above the shoe heel 16.

In conclusion, herein is presented a pants hem guard 10. The invention is illustrated by example in the drawing figures, and throughout the written description. It should be understood that numerous variations are possible, while adhering to the inventive concept. Such variations are contemplated as being a part of the present invention.

What is claimed is:

1. A pants hem guard for attachment to a shoe having a frame, the shoe having a top rim, a heel, and a back portion extending between the rim and the heel, comprising:

a U-shaped inner portion of the frame, the inner portion comprising a pair of sides, each side having a top end and a bottom end, and a bottom member extending between the bottom ends of the sides, wherein the inner portion is positioned on an inside of the back portion of the shoe;

a U-shaped outer portion of the frame, the outer portion comprising a pair of sides, each side having a top end and a bottom end, and a bottom member extending between the bottom ends of the sides, wherein the outer portion is positioned on an outside of the back portion of the shoe;

a pair of horizontal members extending between the top ends of the inner and outer portions, said members connecting the inner portion and the outer portion, wherein the horizontal members bridge the inner and outer portions over the top rim of the shoe; and a clip insert, having a rear surface, the insert attached to the outer portion of the frame, and extending substantially parallel to the outside of the back portion of the shoe, leaving a slight space between the rear surface of the insert and the shoe.

2. The pants hem guard as recited in claim 1, wherein the inner portion is longer than the outer portion, thus the inner portion extends to a bottom surface of a inside of the shoe, and the outer portion is wider than the inner portion.

3. The pants hem guard as recited in claim 2, wherein the bottom member of the outer portion of the frame has two ends, both of the ends are attached to the rear surface of the clip insert.

4. A method of guarding a pants hem by attaching a pants hem guard to a shoe, the guard having a frame and a clip insert, the frame comprising an inner portion having a bottom member, an outer portion having a bottom member, and a pair of horizontal members connecting the inner and outer portions, the shoe having a top rim, a heel, and a back portion extending between the rim and the heel, comprising the steps of:

inserting the inner portion of the frame on an inside of the back portion of the shoe, and leaving the outer portion of the frame on an outside of the back portion of the shoe;

pushing the frame downward, toward the shoe heel, until the bottom member of the inner portion comes into contact with a bottom surface of the shoe, and the horizontal members of the frame rest upon the top rim of the shoe; and tucking the pants hem between the back portion of the shoe and a rear surface of the clip insert, thereby maintaining the hem above the shoe heel.

* * * * *